US006964474B2

(12) United States Patent
Shimoda et al.

(10) Patent No.: US 6,964,474 B2
(45) **Date of Patent: *Nov. 15, 2005**

(54) PRINTING APPARATUS, PRINTING METHOD AND RECORDING MEDIUM

(75) Inventors: Tatsuya Shimoda, Suwa (JP); Hiroshi Kiguchi, Suwa (JP); Satoru Miyashita, Suwa (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/397,723

(22) Filed: Mar. 26, 2003

(65) Prior Publication Data

US 2005/0073566 A1 Apr. 7, 2005

Related U.S. Application Data

(63) Continuation of application No. 09/633,838, filed on Aug. 7, 2000, now Pat. No. 6,561,639, which is a continuation of application No. 09/057,739, filed on Apr. 9, 1998, now Pat. No. 6,126,281.

(30) Foreign Application Priority Data

Apr. 9, 1997 (JP) ..... 9-91199

(51) Int. Cl.[7] ..... B41J 2/01
(52) U.S. Cl. ..... 347/101; 347/102
(58) Field of Search ..... 347/101, 102, 347/43, 105

(56) References Cited

U.S. PATENT DOCUMENTS

| | | | | |
|---|---|---|---|---|
| 4,382,262 A | 5/1983 | Savit | ..... | 347/105 |
| 4,902,568 A | 2/1990 | Morohoshi | ..... | 347/105 |
| 5,644,350 A | 7/1997 | Ando et al. | ..... | 347/101 |

FOREIGN PATENT DOCUMENTS

| | | | | |
|---|---|---|---|---|
| EP | 0 467 141 | 1/1992 | ..... | B41M/5/40 |
| EP | 0 602 494 | 6/1994 | ..... | B41M/5/00 |
| EP | 0 666 363 | 8/1995 | ..... | D06P/3/32 |
| EP | 0 671 268 | 9/1995 | ..... | B41J/2/01 |
| EP | 0 703 087 | 3/1996 | ..... | B41J/2/21 |
| EP | 0 737 592 | 10/1996 | ..... | B41M/5/00 |
| JP | 61-74876 | 5/1986 | ..... | B41J/29/00 |
| JP | 6-48016 | 2/1994 | ..... | B41M/5/00 |
| JP | 6-255235 | 9/1994 | ..... | B41M/5/00 |
| JP | 6-278277 | 10/1994 | ..... | B41J/2/01 |
| JP | 7-689191 | 3/1995 | ..... | B41M/5/00 |
| JP | 08 311782 | 11/1996 | ..... | B41J/2/01 |
| WO | WO 89 05567 | 6/1989 | ..... | H05K/3/14 |

OTHER PUBLICATIONS

Search report from corresponding European Application No. EP 02 02 2549.

Notice of Reasons for Rejection, Japanese Patent Office, Patent Application No. HEI 9 (1997)–091199.

*Primary Examiner*—Manish S. Shah
(74) *Attorney, Agent, or Firm*—Harness, Dickey & Pierce, P.L.C.

(57) ABSTRACT

A highly quality printing of images such as photographs, designs, and the like, is effected without using special paper. The following is provided: a supply mechanism for supplying a recording medium; means for applying a surface modifier for coating the surface modifier on the surface modification area, which is the area to be the modified of the recording medium supplied with the aforementioned means for supplying; and means for drying for drying the surface modification area coated on the aforementioned surface modification area. An area can be printed on the surface modification area with high quality. As such, high quality printing is made possible with regular paper, without using special paper, as before.

3 Claims, 7 Drawing Sheets

1x :INKJET PRINTER HEAD

PRINTING APPARATUS, PRINTING METHOD AND RECORDING MEDIUM

CROSS-REFERENCE TO RELATED APPLICATIONS

This application is a continuation of U.S. patent application Ser. No. 09/633,838 filed Aug. 7, 2000, now U.S. Pat. No. 6,561,639 which is a continuation of U.S. patent application Ser. No. 09/057,739 filed Apr. 9, 1998, now U.S. Pat. No. 6,126,281. This application claims the benefit of Japan 9-91199, filed Apr. 9, 1997.

BACKGROUND OF THE INVENTION

1. Field of the Invention

The present invention relates to a printing apparatus for a personal computer, called a printer, and more particularly to an improved printing technology able to make high quality prints on even regular paper by coating a surface modifier on only a specific portion, where an image is to be printed, of the surface of regular paper, in order for printing an image such as a photograph on regular paper.

2. Description of the Related Art

In recent years, as inexpensive color printers have become mainstream, users have become able to print images, such as photographs and designs prepared on personal computers, using color printers. A printing apparatus (color printer) prints (the term "printing" will hereafter refer to the printing of both images and text) images such as photographs and designs, as well as specified text, with the specified coloration and at one time on printer paper supplied thereto, on the basis of printing information supplied from a personal computer. When the printer paper is a recording medium such as regular paper, however, it is not possible to print images with very good quality because of the poor coloring properties and moisture absorption of the recording medium.

For this reason, when a user wanted to make a high quality print of a photograph or the like, the user had to make the print using special paper, coated with a surface modifier, instead of regular paper. Inventions relating to this special paper include Japanese Patent Laid-open Publication No. 6-48016, Japanese Patent Laid-open Publication No. 6-255235, and Japanese Patent Laid-open Publication No. 7-68919.

However, the special paper is more expensive than regular paper. It is not economical to use expensive special paper for printing a photograph on only one part of the special paper.

Also, only a few types of special paper are commercially available and are not readily available to many offices and storeholds. For this reason, the use of color printers has many limitations; for example, users usually print images such as photographs on regular paper, knowing that the print will be poor quality, or prepare data without using these images.

SUMMARY OF THE INVENTION

In view of the foregoing, an object of the present invention is to make possible high quality printing without the use of special paper.

Specifically, a first issue of the present invention is to provide a printing technology for high quality printing of images, such as photographs and designs, using even regular paper, and without the use of expensive special paper, by coating only a specific area of the recording medium with a surface modifier.

A second issue of the present invention is to provide a printing technology making possible high quality printing of images such as photographs and designs, because the technology is constituted so that users can designate the areas where high quality printing is desired.

A third issue of the present invention is to provide a printing technology making it possible to automatically make high quality prints in the image area, in the case where the printing information includes an image.

A fourth issue of the present invention is to provide a recording medium with which high quality printing is possible, at a lower price than with the conventional special paper, when the portion for high quality printing is determined.

The present invention for resolving the aforementioned first issue is a printing apparatus comprising: means for supplying recording media; means for coating surface modifier on the surface modification area of the recording medium supplied by the aforementioned means for supplying; and means for drying the surface modifier coated on the aforementioned surface modification area.

The recording medium may be made of paper, as well as other materials such as rubber, resin film, or the like. The means for supplying employed may be means for supplying used in printing, such as supplying by means of rollers or supplying by pulling using suction. The means for coating surface modifier is preferably an inkjet system, because an inkjet system is able to coat the appropriate amount of surface modifier at an arbitrary position on the recording medium. However, the means for coating surface modifier may be another method, if the method is means able to coat the surface modifier uniformly and in a specific area various known methods may be used, for example, coating with rollers or balls, coating by spraying, and coating with plates. Various known methods may be used as the means for drying, for example, applying heat or blowing air. For example, an electric heater, hot air draft, or light irradiation may be used.

Also, the present invention is further provided means for printing on the surface of the recording medium, including the surface modification area. The means for printing effects printing, including printing on the surface modification area of the recording medium, after the surface modifier coated on the surface of the recording medium is dried by the means for drying. The means for printing is preferably an inkjet system, but various systems, if printing mechanisms, may be employed, including a dot impact system or laser printer system.

The present invention is further provided means for printing on the surface of the recording medium including the surface modification area. The means for supplying further supplies the recording medium to the means for printing, after the surface modifier coated on the surface of the recording medium is dried with the means for drying. The means for printing effects printing, including printing on the surface modification area, for the recording medium supplied from the means for supplying.

In the printing apparatus for resolving the aforementioned second issue, the aforementioned means for coating surface modifier determines the surface modification area on the basis of information for designating surface modification determined according to user specification.

In the printing apparatus for resolving the aforementioned third issue, the aforementioned means for coating surface modifier specifies the area on the recording medium corresponding to image information as the surface modification area, when printing information for printing from the means for printing includes image information.

Moreover, the aforementioned means for printing is preferably means for color printing constituted so as to effect color printing with a plurality of colored inks.

The invention for resolving the aforementioned first issue comprises the following: rollers constituted to supply the recording medium; a roller motor to drive the rollers on the basis of a roller driving signal; surface modifier head constituted to expel surface modifier on the basis of the surface modification signal; head motor for driving the surface modifier head to the arbitrary position of the supplied recording medium on the basis of the head driving signal; heater disposed so as to dry the surface modifier expelled on the recording medium on the basis of a heating signal; and control apparatus constituted to output the roller driving signal, the head driving signal, and the heating signal. The control apparatus is constituted to determine the surface modification area, where the surface of the recording medium is to be modified, on the basis of printing information for printing on the recording medium, and to cause the recording medium to be supplied and the surface modifier to be expelled by the surface modifier head on the surface modification area. Furthermore, the present invention is further provided a print head constituted to print on the surface of the recording medium including the surface modification area on the basis of a printing signal. After the surface modifier coated on the surface of the recording medium is dried with the heater, the aforementioned control apparatus then effects printing with the print head, including printing on the surface modification area of the recording medium.

Also the present invention is further provided a print head constituted to print on the surface of the recording medium, including the surface modification area, on the basis of the printing signal. After the surface modifier coated on the surface of the recording medium is dried with the heater, the aforementioned control apparatus causes the recording medium to be supplied to the print head by the rollers and roller motor and causes printing by the print head on the recording medium, including printing on the surface modification area.

In the printing apparatus for resolving the aforementioned second issue, the control apparatus determines the surface modification area on the basis of information for designating surface modification, which was input from the input apparatus with an operation by the user.

In the printing apparatus for resolving the aforementioned third issue, the aforementioned control apparatus determines an area on the recording medium corresponding to image information as the surface modification area, when printing information for effecting printing with the print head includes the image information.

The print head is constituted to effect color printing with a plurality of colored inks; the control apparatus preferably supplies a printing signal for color printing to the print head and thereby effects color printing.

For example, the print head is constituted to be transported with a head motor, along with the surface modification head. The print head is constituted to be transported independently from the surface modification head and is further provided a head motor to transport the print head.

Also, the surface modifier preferably comprises one or more of the following: a mixture of porous silica grains and alumina sol, a mixture of porous silica grains and alumina hydrate, silica and boehmite, ultraviolet absorber, antioxidant, and quencher. The invention for resolving the aforementioned first issue is a printing method for the printing apparatus for printing on a recording medium. The method is a printing method comprising the steps of supplying recording medium; coating surface modifier on the surface modification area of the supplied recording medium; drying the surface modifier coated on the surface modification area; and printing, including printing on the surface modification area, on the recording medium after the surface modifier coated on the surface of the recording medium is dried.

Furthermore, the present invention is further provided the steps of returning the recording medium once more after the step of applying the surface modifier and supplying the recording medium once more after the step of drying the surface modifier.

The invention for resolving the aforementioned second issue is a printing method for determining the surface modification area on the basis of information for designating surface modification specified by the user.

The invention for resolving the aforementioned third issue is a printing method for establishing an area on the recording medium corresponding to image information as the surface modification area, when printing information for printing includes the image information.

The invention for resolving the aforementioned fourth issue is a recording medium wherein a partial area, where high resolution printing is required, is coated with a surface modifier comprising one or more of the following: a mixture of porous silica grains and alumina sol, a mixture of porous silica grains and alumina hydrate, silica and boehmite, ultraviolet absorber, antioxidant, and quencher.

DESCRIPTION OF THE PREFERRED EMBODIMENT

Next, the preferred embodiments of the present invention are explained with reference to the figures.

First Embodiment

The first embodiment of the present invention relates to an inkjet printer which is provided a mechanism for applying surface modifier, wherein surface modification is set on the computer side.

General Constitution

Figure 1:
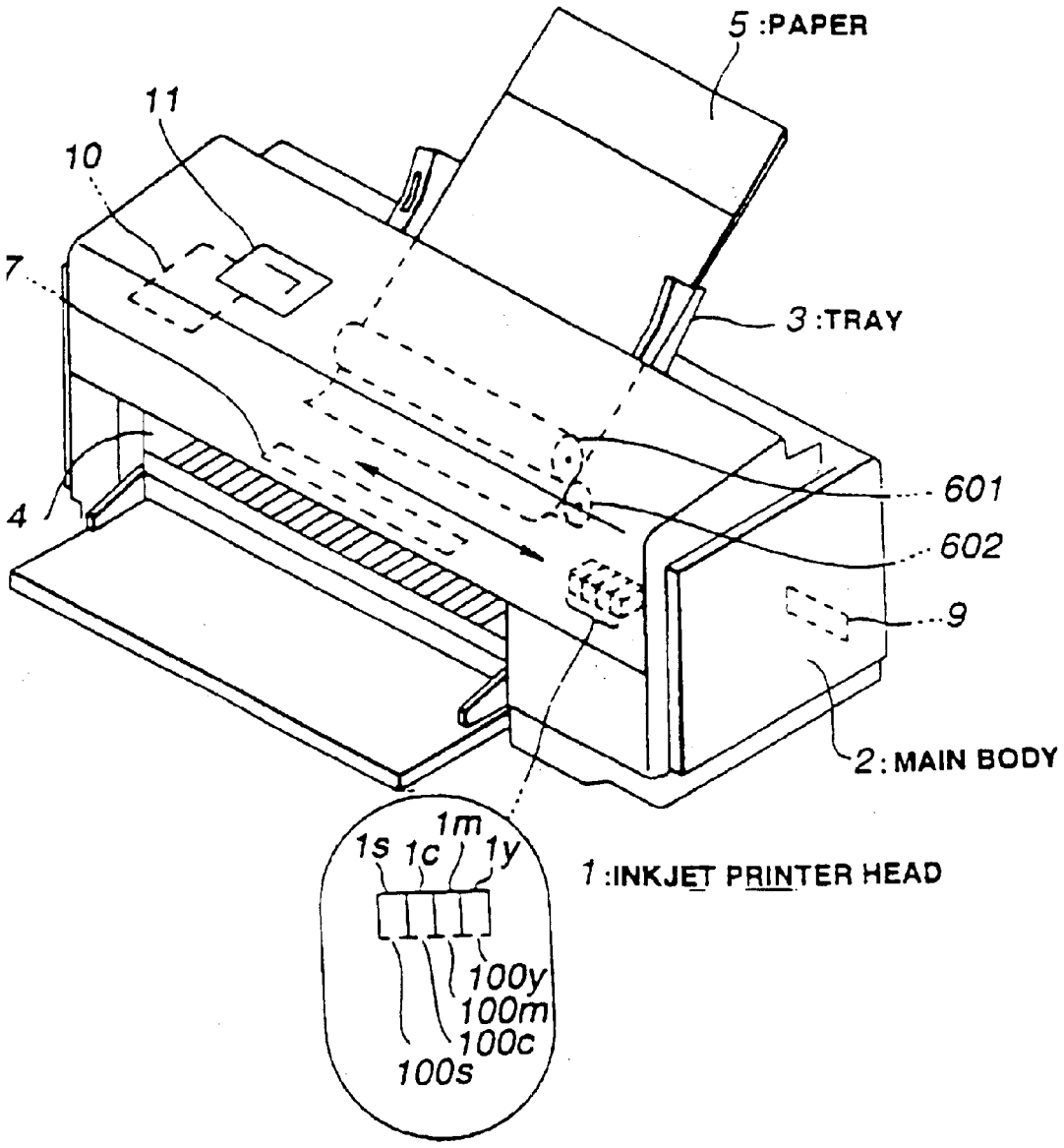
FIG. 1 is a perspective view of an inkjet printer (printing apparatus) relating to the present invention.

As shown in FIG. 1, the inkjet printer in the present embodiment is provided inkjet print head 1, a main body 2, a tray 3, an output opening 4, supply mechanism 6 (rollers 601, 602 and the motor 600 shown in FIG. 3), heater 7, connector 9, control circuit 10, and an operation button 11.

Figure 2:
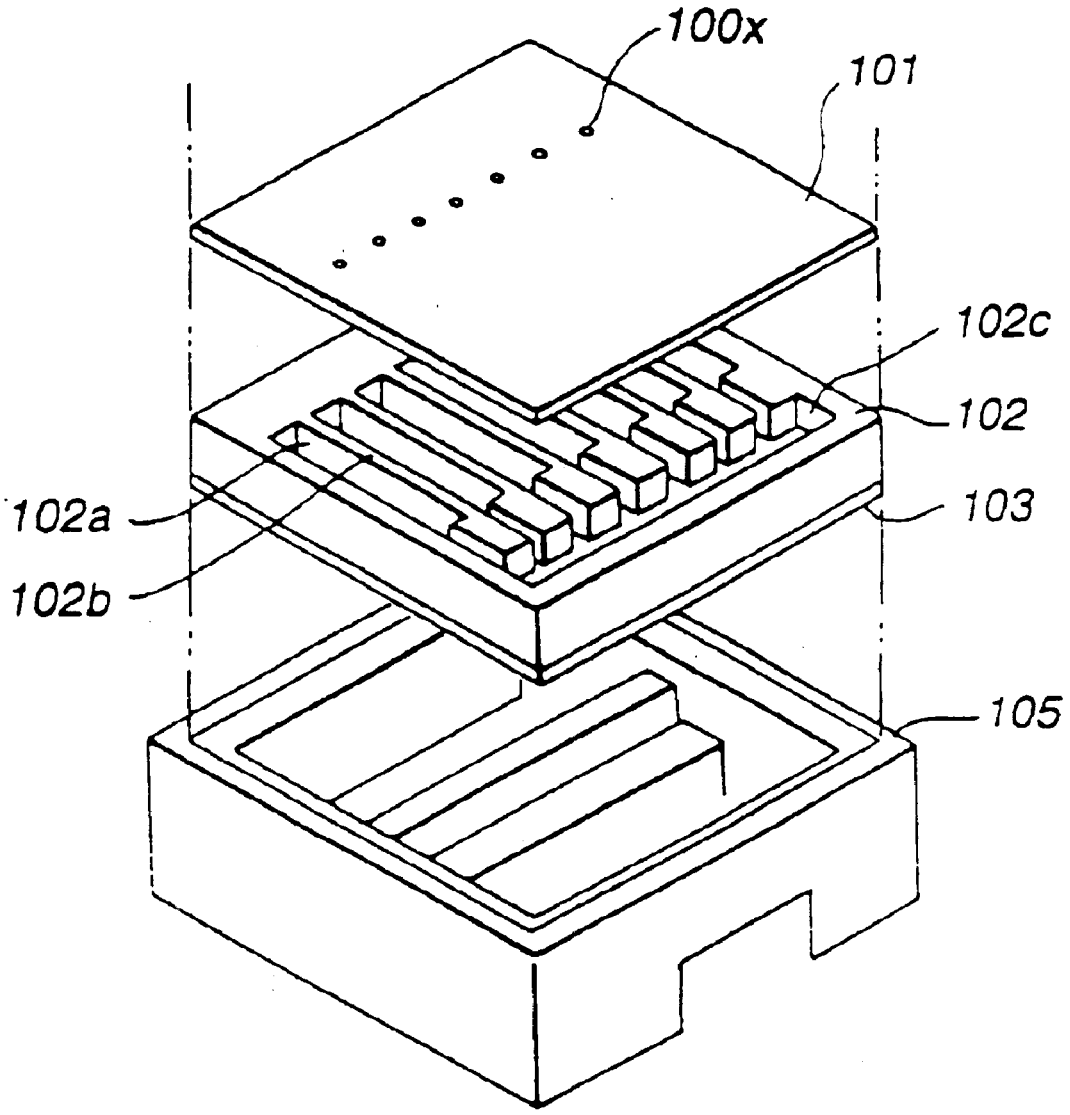
FIG. 2 is a perspective view of a breakdown of the inkjet print head relating to the present invention.

As shown in the detail in this figure, the inkjet print head 1 is provided heads 1*s*, 1*c*, 1*m*, and 1*y*, each having the same structure. Different material is expelled from each head. The inkjet print head 1 is constituted to be moved in a direction crosswise to the paper 5 with the motor 101 shown in FIG. 3. The head 1*s* is means for coating surface modifier and is constituted to expel surface modifier from its nozzle 100*s* according to a surface modifier signal supplied from the control circuit 10. Heads 1*c*, 1*m*, and 1*y* are means for printing; the heads are constituted so that the head 1*c* expels cyan ink from its nozzle 100, the head 1*m* expels magenta ink from its nozzle 100*m*, and the head 1*y* expels yellow ink from its nozzle 100*y*, according to a printing signal supplied from the control circuit 10. Each head 1 (*s, c, m, y*) is provided a nozzle plate 101, cavity plate 102, vibrating layer 103, and housing 105, as shown in FIG. 2.

The nozzle plate 101 is disposed on the nozzle 100*x* (x indicates that this may apply to s, c, m, or y). A cavity 102*a*, side wall 102*b*, and shared flow path 102*c* are established on the cavity plate 102. Expelled material, being any of the surface modifier, cyan ink, magenta ink, or yellow ink supplied from an ink tank (not shown), can fill therein. A thin film element, not shown, is established on the vibrating layer 103; the vibrating layer can be deformed in response to the surface modifier signal or the cyan, magenta, or yellow printing signal from the control circuit 10. The housing 105 is constituted so that the cavity plate 102, whereon the nozzle plate 101 and the vibrating layer 103 are mounted, fits therein.

Consequently, each head is constituted so that the foregoing expelled material can be expelled from the nozzle 100*x*, because the pressure in the cavity 102*a* increases when the vibrating layer 103 is deformed in response to a signal from the control circuit 10.

Moreover, the present embodiment presupposes an inkjet print head, but this might also be a spray type head, which expels ink drops because of increased pressure due to bubbles formed by raising the ink temperature.

Also, the present embodiment does not use black ink, for the purpose of simplifying the explanation, but might also use a head for expelling drops of black ink for printing a distinct black color.

Returning to FIG. 1, the main body 2 is a body of an inkjet printer 1; supply mechanism 6 (601, 602 and 600) are arranged in a position where the rollers can supply the paper 5 from the tray 3; the inkjet print head is arranged so that it can move crosswise over the paper 5 supplied by the rollers 6; and a heater 7 is arranged in a position where it can heat each character, or the like, on the paper 5 printed by this head 1.

The tray 3 is constituted to supply the paper 5, before printing, to the supply mechanism 6.

The output opening 4 is provided a constitution for outputting the paper 5 when printing is complete.

The paper 5 is a recording medium, for which regular paper can be used, as well as OHP (overhead projector) sheets, or the like.

A medium, to be the subject of color printing such as photographs and designs, is employed.

The rollers 6 (601, 602, and 600) are constituted to supply the paper 5 in the direction of the output opening 4 with a driving signal output from the control circuit 10, or to transport the paper 5 in a direction opposite thereto.

The heater 7 is a drying mechanism and is constituted to generate heat when a heating signal is output from the control circuit 10. The temperature increase of the paper 5 from this heating is set to a level sufficient for drying the surface modifier.

The connector 9 is constituted to connect a printer cable (not shown) for supplying printing information output by a computer apparatus (not shown). For example, the pins are provided to make possible connection with a general purpose computer apparatus with a Centronics-based protocol.

Figure 3:
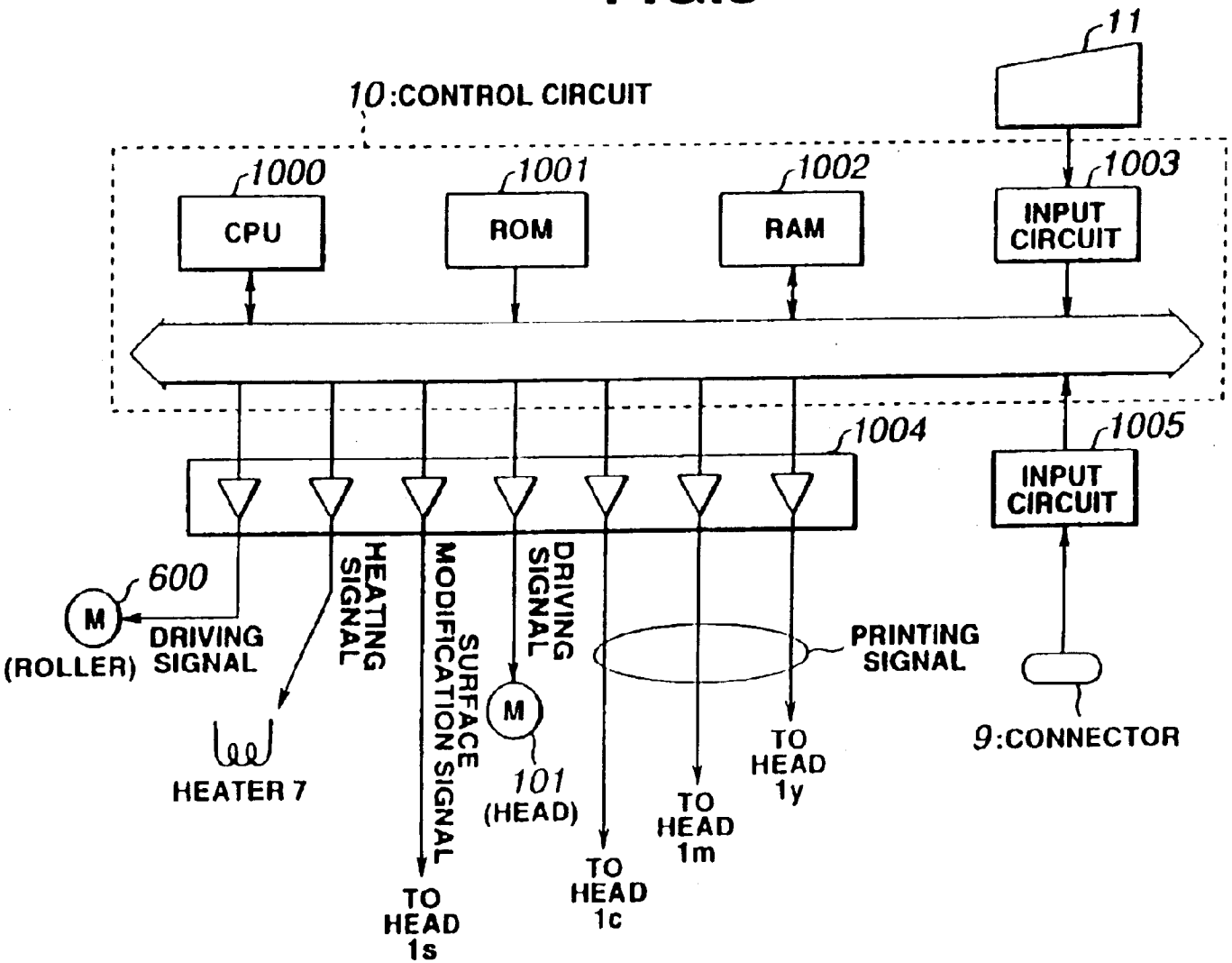
FIG. 3 is a block diagram of a control circuit 10.

The control circuit 10 is provided a CPU 1000, ROM 1001, RAM 1002, input circuit 1003, output circuit 1004, input circuit 1005, and bus 1006, as shown in FIG. 3.

The CPU 1000 is constituted to operate the rollers 601, 602 as means for supplying by outputting a driving signal to the motor 600 and to operate the heater 7 as means for drying by outputting a heating signal, according to a control program stored in the ROM 1001. Also, the CPU 1000 is constituted to operate the head 1*s* as means for coating surface modifier by outputting a surface modifier signal to the head 1*s* and to operate the heads 1*c*, 1*m*, and 1*y* as means for printing by outputting a printing signal. Moreover, in the present embodiment, "printing information" means the information for printing sent from the computer; "printing signal" means the signal output by the control circuit 10 to the heads 1*c*, 1*m*, and 1*y*.

The ROM 1001 is constituted to store the operating program for the CPU 1000. The RAM 1001 is the temporary memory necessary for operating the CPU 1000 and is constituted to store the printing information supplied via the connector 9. The input circuit 1003 is constituted to supply the operating signals from the operation button 11 to the CPU 1000. The output circuit 1004 is constituted to supply the printing signal, surface modifier signal, driving signal, heating signal, and driving signal from the CPU 1000, to the head 1*s*, and the heads 1*c*, 1*m*, and 1*y*, motor 101, heater 7, and motor 600 respectively. The input circuit 1005 is constituted to output the printing information supplied from the connector 9 to the bus 1006. The bus 1006 is constituted to be able to connect together the CPU 1000, ROM 1001, RAM 1002, input circuit 1003, output circuit 1004, and input circuit 1005.

Back in FIG. 1, the operating button 11 is constituted to output an operating signal, indicating the operation details of the apparatus, to the input circuit 1003, when operated by a user. In other words, this inkjet printer is a printing apparatus which is provided the following: a supply means (supply mechanism 6 and control apparatus 10) for supplying a recording medium (paper 5); surface modifier means (head 1*s*, motor 101, and control apparatus 10) for coating surface modifier on a surface modification area, where the surface is to be modified, of the surface of the recording medium supplied by the supply means; and a drying means (heater 7 and control apparatus 10) for drying the surface modifier coated on the surface modification area.

The surface modifier is constituted to comprise one or more of the following: a mixture of porous silica grains and alumina sol, a mixture of porous silica grains and alumina hydrate, silica and boehmite, ultraviolet absorber, antioxidant, and quencher. A surface modifier having the following composition is especially preferable.

1) An ink made of a binder with a mixture of porous silica grains and alumina sol (mean grain diameter 2–50 . mu.m, mean pore diameter 8-nm, pore volume 0.8–2.5 $cm^3/g$).

2) An ink comprising silica and boehmite, wherein the boehmite content is 0.5–3.0 wt %, and the silica content per 1 wt % of boehmite is 0.1–0.4 wt %.

3) A composition of the foregoing inks in 1) and 2) with improved light fastness and coloring properties because of the addition of ultraviolet absorber, antioxidant, and quencher.

Also a surface modifier in ink form preferably has a viscosity of $1\times10^{-2}$Pa·s or less, and more preferably about $3\times10^{-3}$Pa·s. A higher viscosity makes it difficult to expel straight from the nozzle. If the viscosity is too low, the surface modifier easily soaks into regular paper and cannot form an optimum layer; it also takes more time to dry.

Also, for dispersion properties, a dispersion with a mean grain diameter of 1 $\mu$m or less is preferable. If dispersion is too great, the surface modifier will coat portions outside the image area.

Explanation of Printing Method

Figure 4:
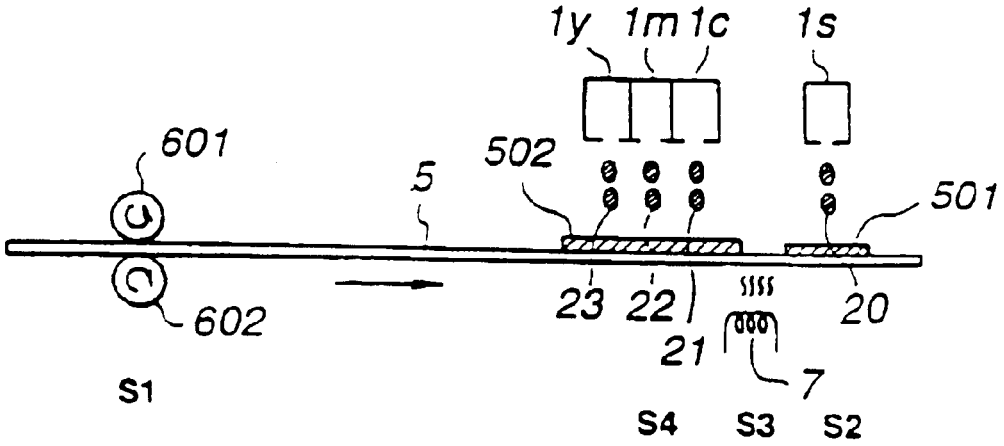
FIG. 4 is a process diagram for explaining the manufacturing method in the first embodiment.

Next, the method for printing with the printing apparatus in this first embodiment is explained. As shown in FIG. 4, the printing method of the present invention is provided the following: a step (S1) for supplying the recording medium (paper 5); a step (S2) for coating the surface modifier on the surface modification area of the supplied recording medium with the head 1*s* and control apparatus 10; a step (S3) for drying the surface modifier coated on the surface modification area with the heater 7 and control apparatus 10; and a step (S4) for effecting printing, including printing on the surface modification area, with the control circuit 10 and the heads 1*c*, 1*m*, and 1*y*, after the surface modifier coated on the surface of the recording medium is dried. This is explained below. The inkjet printer of the present embodiment prints according to printing information sent from a computer connected by means of the connector 9. The printing information has two modes: the case when the surface modification area is not designated on the printer side (mode 1), and the case when the surface modification area is designated on the printer side (mode 2). The first embodiment is the case of mode 1.

Figure 7:
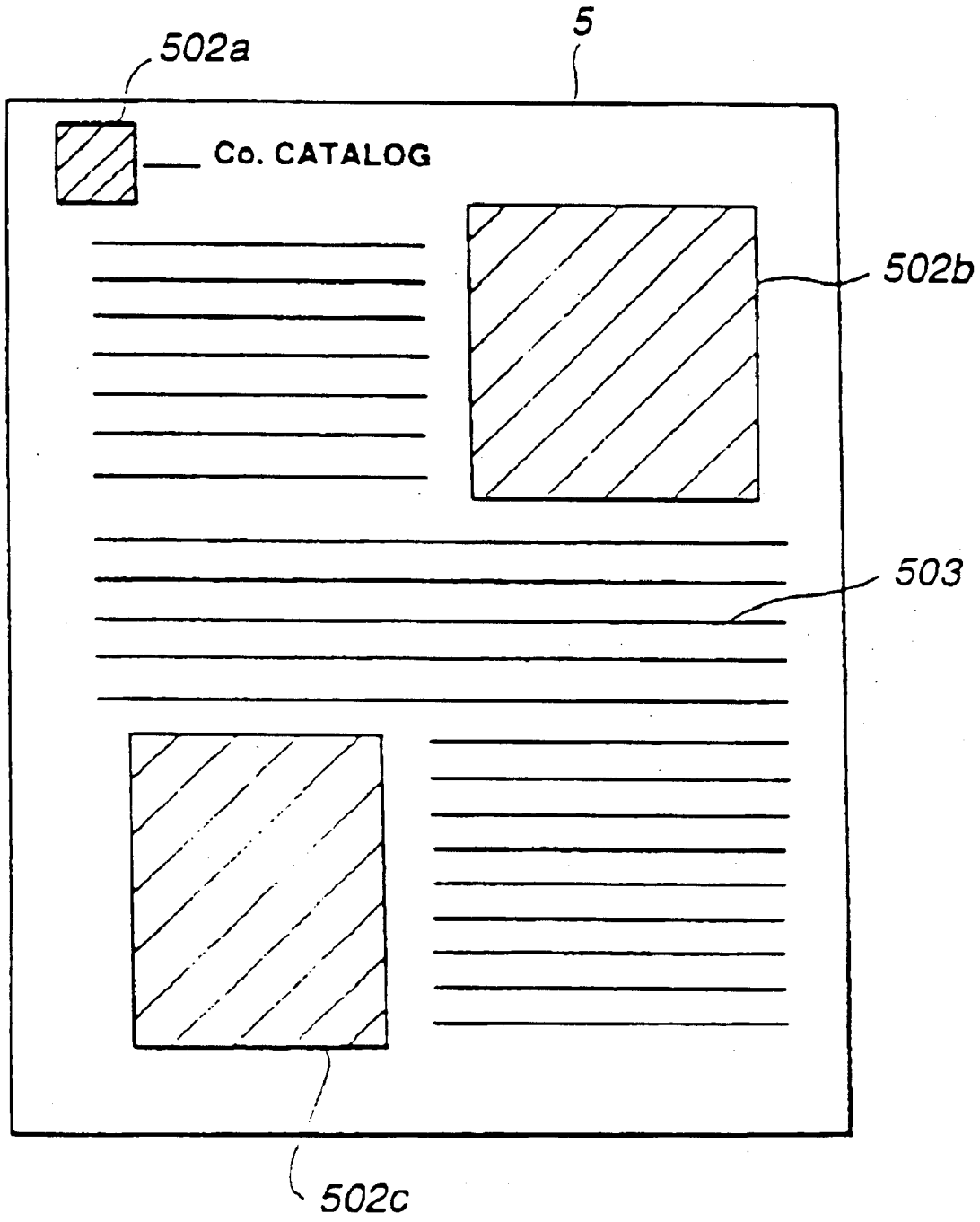
FIG. 7 is a print sample (catalog) where printing is complete.

Now, the user prepares a document using a word processor installed on the computer and commands the computer to print the prepared document. This document relates to a catalog as shown in FIG. 7 and is constituted of a design 502*a* and photographs 502*b* and 502*c*, as well as the text 503. The design and photographs are inserted as image information (bit map data).

When commanded to print, the computer starts a printer driver program for the pertinent inkjet printer, converts the document information prepared with the word processor to printing information which can be printed with the inkjet printer, and outputs the printing information to the printer.

When image information is included in the document information, the printer driver program generates information for designating surface modification to indicate the modification of an area of the surface of the paper 5 corresponding to the image and outputs this information for designating surface modification separately from the usual printing information or appended to the printing information. This information for designating surface modification includes the command for modifying the surface of the paper and area information designating the position on the paper of the area to be modified. Moreover, the information for designating surface modification may be output in advance of the printing information or at the same time as the printing information. When information for designating surface modification is sent from the computer, the CPU 1000 of the control circuit 10 of this printer stores that information in the RAM 1002 and modifies the surface in step S2 on the basis of that information.

Moreover, as discussed above, the constitution may be such that the computer automatically indicates the information for designating surface modification, or that a computer user can arbitrarily designate surface modification. In other words, the present invention can be constituted so that a user can designate areas where high quality printing is desired, regardless of whether photographs or designs are included in the document to be printed, using the input apparatus of the computer. In this case, the computer generates information for designating surface modification, to command surface modification of the designated area on the paper, and outputs this information to the printer. With this method, areas where better printing is desired, even for information such as text, can be freely designated; and this method is effective when clear printing is desired for an epigraph or the like.

Meanwhile, the printer may be constituted so that surface modification is nullified when the user operates the input apparatus 11, regardless of whether information for designating surface modification is sent from the computer. For example, this is effective in the case where a user wants to print using a so-called backing sheet, just to check the printed contents, such as when making a test print.

Step S1 (paper supply): The control circuit 10, which received the printing information, outputs a driving signal, corresponding to a code indicating the start of document printing and repagination in the printing information, to the motor 600, and causes the rollers 601 and 602 to rotate and supply the paper five into the main body 2. When the information for designating surface modification for modifying the surface is output for a page to be printed, the control circuit 10 causes the heater 7 to heat up and at the same time prepares the head is for expelling the surface modifier.

Figure 5:
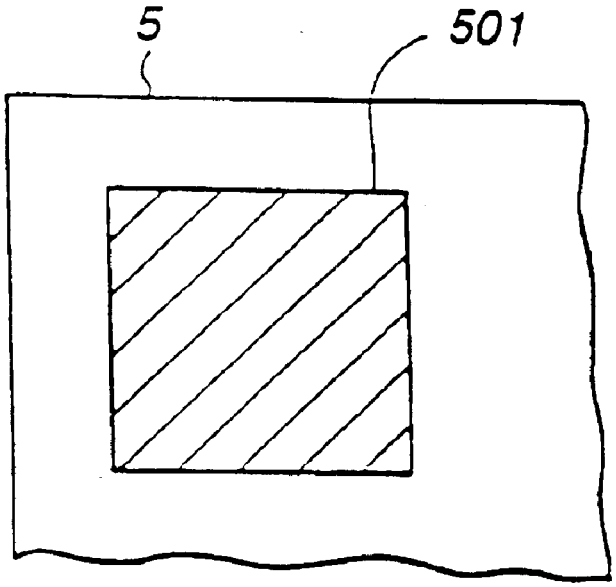
FIG. 5 is a front view of paper where the surface modification area is coated.
Figure 6:
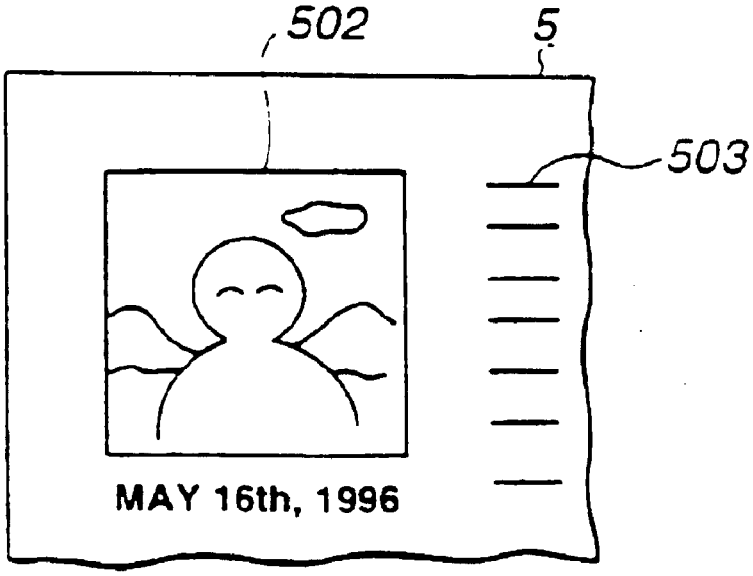
FIG. 6 is a front view of paper on which an image is printed.

Step S2 (coating surface modifier) When the printing information includes the information for designating surface modification, the rollers 601, 602 and head 1*s* are driven until the head 1*s* is positioned on the surface modification area, on the basis of the position information of the area to be modified, and the head is expels the surface modifier 20 on the basis of the surface modification signal. The surface modification area 501 is formed on the paper 5 when the surface modifier 20 is expelled. This surface modification area 501 is the area where an image is printed, as shown in FIGS. 5 and 6.

Step S3 (drying): When the printing information includes information for designating surface modification, the control circuit 10 causes the heater 7 to heat. The heater 7 promotes the drying of the surface modifier by heating and drying the surface modification area 501. The heating temperature depends on the composition of the surface modifier, but about 80° C. is appropriate. The drying time is appropriately about 120 seconds. If the drying temperature is too high or the drying time too long, the paper may deform or degrade. If the drying temperature is too low or the drying time too short, the surface modifier will not be sufficiently dried.

Step S4 (printing): When drying with the heater 7 is complete, the control circuit 10 outputs a printing signal to the heads 1*c*, 1*m*, and 1*y*, outputs a driving signal to the motor 101, and causes printing on the entire surface of the paper 5, including the surface modification area. At this time, an image 502, such as a photograph, design, or the like, based on the image data is printed on the surface modification area 501. Text and the like is printed together with the image printing. For example, in FIG. 6, the image 502 is a photograph for which is explained by the explanatory text 503 and the date the photograph 502 was taken is printed below the photograph.

In a catalog printed with the aforementioned procedure, as shown in FIG. 7, a design 502*a* showing a company name and photographs 502*b*, 502*c* are printed on the surface modification area; explanatory text 503 is printed directly on the regular paper. Because the design and photographs are printed on the surface modification area 501, the printing is of the same high quality as when special paper is used.

As noted above, because in the first embodiment an inkjet printer is provided means for coating surface modifier and a control circuit for coating surface modifier therewith, the first embodiment is able to modify the surface of the surface modification area and make high quality prints using regular paper, when surface modification is necessary. This embodiment is especially effective in the case where the surface modifier dries quickly.

A portion with the surface modified in this way has good properties such as ink coloration, color reproduction, uniform dot formation; print density is high and the concentration is uniform. Such a surface modified portion provides high quality prints with little bleeding and sharp edges.

Also, when the surface modifier is blended with an ultraviolet absorber and antioxidant, the image preservation is superior in terms of weather resistance (especially ozone resistance), light fastness (especially ultraviolet light), water resistance, and less bleeding because of changes over time.

Furthermore, other properties are that the paper does not easily curl and the surface modifier layer does not peel off.

Second Embodiment

In the aforementioned first embodiment, the printing information sent from the computer included the information for designating surface modification and printing in accord therewith was effected by the inkjet printer. In the second embodiment, however, the mode (mode 2) for setting the surface modification area on the printer side is explained with the same constitution as the first embodiment.

The constitution of the second embodiment is the same as that of the first embodiment; an explanation thereof is not included. In the case of setting the surface modification area on the printer side, the computer outputs the document information to the printer without any further processing. In other words, the text information is output as text information and the image information as image information; no information for commanding surface modification is included.

In the case where image information is included in the printing information sent from the computer, the CPU 1000 of the control circuit 10 for the printer meanwhile prepares data to the effect of performing surface modification at a position on the paper 5 corresponding to that image information and stores this data in the RAM 1002. This data includes information specifying the position on the paper to undergo surface modification, in the same way as the aforementioned information for designating surface modification.

Moreover, the embodiment may also be constituted so that the user can indicate with the computer whether to perform surface modification. In other words, the embodiment is constituted so that the user can set the validity/invalidity of surface modification in the printer driver program and can output a command showing this validity/invalidity to the printer. In such a constitution, the printer effects the setting for surface modification only when this command is valid.

Also, the constitution may be such that a user may set surface modification to be invalid, regardless of whether the printing information includes image information, by operating the printer input apparatus 11.

The method for printing, excluding the setting of surface modification, is the same as in the aforementioned first embodiment and an explanation thereof is not included. In the step (corresponding to the aforementioned S2) for coating the surface modifier, the control circuit 10 effects coating of the surface modifier on the basis of the position information for the surface modification area it the control circuit 10 established in the RAM 1002.

As noted above, the second embodiment determines the contents of the printing information on the printing apparatus side and applies the surface modifier in the case where surface modification is authorized; printing can therefore be done from a usual computer apparatus where a printer driver program, specifically for this printer, is not installed.

Third Embodiment

In the aforementioned first embodiment, printing is effected without further processing after application of the surface modifier; in the second embodiment, however, the paper is returned to the supply starting position.

Figure 8:
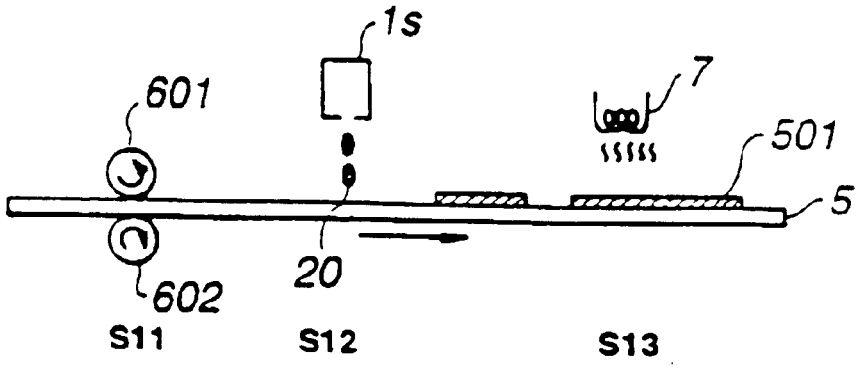
FIG. 8 is a process diagram (S11–S13) of the manufacturing method in the third embodiment.
Figure 9:
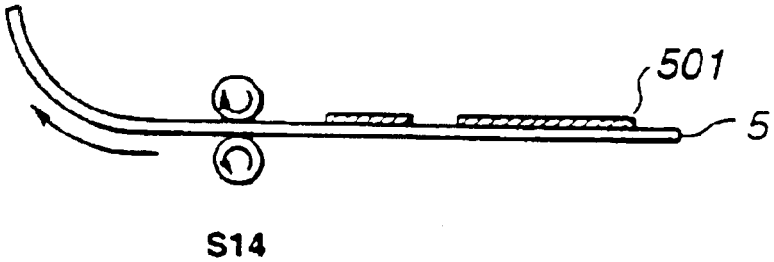
FIG. 9 is a process diagram (S14) of the manufacturing method in the third embodiment.
Figure 10:
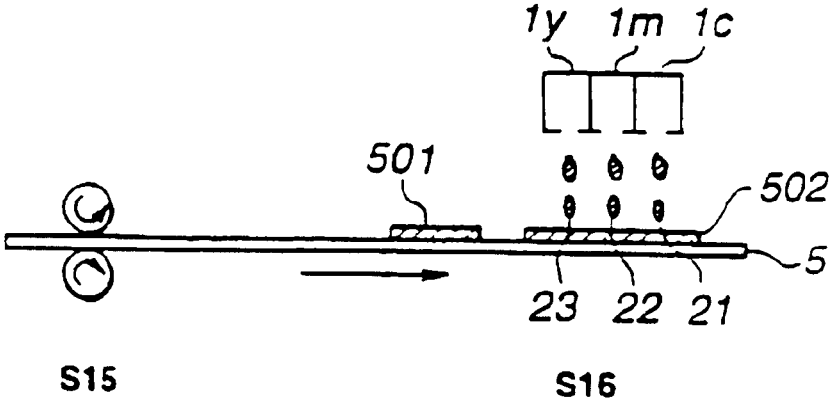
FIG. 10 is a process diagram (S15, S16) of the manufacturing method in the third embodiment.

The constitution of the third embodiment is the same as the first embodiment and the explanation is therefore omitted. The setting of the surface modification area is based on the information for designating surface modification sent from the computer apparatus, like in the first embodiment; the surface modification area may also be set like in the second embodiment, where the printer device recognizes image data and sets the surface modification area. Next, the printing method of the present embodiment is explained using FIGS. 8–10.

Steps S11–S13 (supply paper, apply surface modifier, drying): These steps are the same as steps S1–S3 in the first embodiment.

Step 514 (rewind): When the surface modification area 501 is completely dried, the control circuit 10 reverses the rollers 6 and returns the paper 5 to the supply starting position.

Step S15 (resupply): The rewound paper 5 is re-supplied. At this time, the control circuit 10 causes heads 1*c*, 1*m*, and 1*y* to prepare to print.

Step S16 (print): This printing is the same as that in step S4 in the aforementioned first embodiment.

Moreover, in step S14, it may also be the case that the paper 5 is not rewound and instead, the paper 5 whereon a surface modification area is formed may be output from the output opening 4. In this case, when the user wants to print, the user once more sets the paper, whereon a surface modification area is formed, in the tray 3 and gives the command to print. This is effective in the case where a user wants to make a high quality image print with a printer other than the printer relating to the present invention for effecting surface modification, or in the case where the surface modifier requires a very long time to dry.

Also, the present invention may be a printing apparatus which is provided only the surface modifier head 1*s* and is not provided the print heads 1*c*, 1*m*, and 1*y*. In other words, the present invention may constitute a printing apparatus which is a dedicated device for forming surface modification areas. With such an apparatus, a user can print text, images, and the like, with a different printer than the printer for surface modification processing.

Furthermore, a user can distribute paper whereon the surface modifier is applied only to a specific area in this way. If the position on the paper where images are to be inserted is designated in advance, another user can make high quality prints with another computer and printer, using regular paper with part of the surface modified. Because the area using surface modifier is small, regular paper, that makes possible high quality printing, can be provided at a much lower price than special paper.

As noted above, in the third embodiment, the surface modifier is applied and dried, and the paper is rewound and then re-supplied and printed; therefore, the third embodiment is especially effective in the case where the surface modifier needs time to dry.

In other words, with the present invention, a user can make high quality prints of images such as photographs, designs, and the like, just using regular paper, and without using expensive special paper, because surface modifier is applied only to a specific area of the recording medium.

With the present invention, users can designate the areas where they want to make high quality prints and make high quality prints of images such as photographs, designs, and the like.

The present invention can automatically make a high quality print on a corresponding surface modification area, in the case where an image is included in printing information.

In the case where a portion, for which high quality printing is desired, is determined, the present invention can provide a recording medium which makes possible high quality printing at less expense than with conventional special paper.

The entire disclosure of Japanese Patent Application No. 9-91199 filed on Apr. 9, 1997, including specification, claims, drawings, and summary are incorporated herein by reference in its entirety.

The present invention can make high quality prints of images such as photographs, designs, and the like, without using special paper.

What is claimed is:

1. An ink expelling apparatus comprising:

a coating device including:

an ink coating part for coating an ink-coating surface with ink; and a surface modifier coating part for coating a surface modification area of the ink-coating surface with a surface modifier;

a controlling circuit for controlling said ink coating part and said surface modifier coating part;

a supplying device for supplying a recording medium having a recording surface as said ink-coating surface; and a drying device for drying said surface modifier applied to said surface modification area;

wherein said controlling circuit determines an image information area which is included in said ink coating information area being applied on said ink-coating surface, and said controlling circuit produces a controlling signal which controls said surface modifier coating part to coat said image information area as said surface modification area;

said ink coating part is comprised of print heads for printing on said recording surface;

said print heads effect printing on said recording surface of said recording medium, including printing on sai surface modification area which is coated with said surface modifier and dried with said drying device;

said supplying device supplies said recording medium to said print heads after said surface modifier applied to said surface modification area is dried with said drying device; and said print heads effect printing, including printing on said surface modification area, on said recording medium supplied by said supplying device.

2. The apparatus according to claim 1, wherein said print heads are adapted to print a plurality of colored inks.

3. An ink expelling apparatus comprising:

an ink jet head including a plurality of expelling heads, said plurality of expelling heads including:

an ink expelling head for selectively coating an ink-coating surface with ink; and a surface modifier expelling head for selectively coating a surface modification area of the ink-coating surface with a surface modifier;

a controlling circuit for controlling said ink expelling head and said surface modifier expelling head;

a supplying device for supplying a recording medium having a recording surface as said ink-coating surface; and a drying device for drying said surface modifier applied to said surface modification area;

wherein said controlling circuit determines an image information area which is included in said ink coating information area being applied on said ink-coating surface, and said controlling circuit produces a controlling signal which controls said surface modifier expelling head to coat said image information area as said surface modification area;

said ink expelling head is comprised of print heads for printing on said recording surface;

said print heads effect printing on said recording surface of said recording medium, including printing on said surface modification area which is coated with said surface modifier and dried with said drying device;

said supplying device supplies said recording medium to said print heads after said surface modifier applied to said surface modification area is dried with said drying device; and said print heads effect printing, including printing on said surface modification area, on said recording medium supplied by said supplying device.

* * * * *

UNITED STATES PATENT AND TRADEMARK OFFICE

CERTIFICATE OF CORRECTION

PATENT NO. : 6,964,474 B2
APPLICATION NO. : 10/397723
DATED : November 15, 2005
INVENTOR(S) : Tatsuya Shimoda, Hiroshi Kiguchi and Satoru Miyashita It is certified that error appears in the above-identified patent and that said Letters Patent is hereby corrected as shown below:

| | |
|---|---|
| Title Page, Item (56), References Cited: | Under U.S. PATENT DOCUMENTS insert<br>-- 5,579,693 12/1996 Carreira et al. 101/424.1 --<br>-- 6,126,281 10/2000 Shimoda et al. 347/101 --<br><br>Under FOREIGN PATENT DOCUMENTS insert:<br>-- JP 6-255096 9/1994 -- |
| Title Page, Item (57), Abstract, Line 2: | "highly" should be -- high -- |
| Column 8, Line 34: | "is" should be -- 1*s* -- |
| Column 8, Line 41: | "is" should be -- 1*s* -- |
| Column 10, Line 40: | "Step 514" should be --- Step S14 -- |
| Column 12, Line 8: | "sai" should be --- said -- |

Signed and Sealed this

First Day of August, 2006

JON W. DUDAS
*Director of the United States Patent and Trademark Office*